US011148891B2

(12) United States Patent
Arai et al.

(10) Patent No.: US 11,148,891 B2
(45) Date of Patent: Oct. 19, 2021

(54) SHEET CONVEYING DEVICE AND IMAGE FORMING APPARATUS INCORPORATING THE SHEET CONVEYING DEVICE

(71) Applicants: Daisuke Arai, Tokyo (JP); Takehiro Fujita, Kanagawa (JP)

(72) Inventors: Daisuke Arai, Tokyo (JP); Takehiro Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 48 days.

(21) Appl. No.: 16/140,949

(22) Filed: Sep. 25, 2018

(65) Prior Publication Data

US 2019/0161298 A1 May 30, 2019

(30) Foreign Application Priority Data

Nov. 29, 2017 (JP) ..... 2017-229074
Sep. 18, 2018 (JP) ..... JP2018-173738

(51) Int. Cl.
*B65H 5/06* (2006.01)
*B65H 7/02* (2006.01)
(Continued)

(52) U.S. Cl.
CPC ..... *B65H 5/062* (2013.01); *B65H 7/02* (2013.01); *B65H 7/14* (2013.01); *B65H 9/002* (2013.01);
(Continued)

(58) Field of Classification Search
CPC ... B65H 5/062; B65H 7/02; B65H 2404/1441
See application file for complete search history.

(56) References Cited

U.S. PATENT DOCUMENTS 9,776,819 B2 * 10/2017 Yamane ..... B65H 9/002
10,358,311 B2 * 7/2019 Yamane ..... B65H 9/002
(Continued)

FOREIGN PATENT DOCUMENTS

EP 1980512 A2 10/2008
JP 6-234441 8/1984
(Continued)

OTHER PUBLICATIONS

Extended Search Report for corresponding European Application No. 18196089.9 dated Apr. 16, 2019.
Chinese Office Action dated Feb. 3, 2020.

*Primary Examiner* — Howard J Sanders
(74) *Attorney, Agent, or Firm* — Harness, Dickey & Pierce, P.L.C.

(57) ABSTRACT

A sheet conveying device, which is included in an image forming apparatus, includes a pair of rotary bodies configured to convey a sheet and correct a positional deviation of the sheet, a pair of downstream side sheet conveying bodies disposed downstream from the pair of rotary bodies in a sheet conveying direction and configured to convey the sheet, and a detector configured to detect separation of the pair of rotary bodies. The pair of rotary bodies moves the sheet by moving from a home position on a sheet conveyance passage through which the sheet passes. The pair of rotary bodies moves to the home position while the pair of downstream side sheet conveying bodies is conveying the sheet, in response to detection of the separation of the pair of rotary bodies by the detector.

19 Claims, 13 Drawing Sheets

(51) Int. Cl.

| | |
|---|---|
| ***B65H 9/00*** | (2006.01) |
| ***B65H 9/10*** | (2006.01) |
| ***B65H 7/14*** | (2006.01) |

(52) U.S. Cl.

CPC ..... *B65H 9/103* (2013.01); *B65H 2404/1424* (2013.01); *B65H 2404/1441* (2013.01); *B65H 2404/14212* (2013.01); *B65H 2511/20* (2013.01); *B65H 2511/224* (2013.01); *B65H 2513/40* (2013.01)

(56) References Cited

U.S. PATENT DOCUMENTS

| | | | | |
|---|---|---|---|---|
| 2008/0251998 | A1* | 10/2008 | Muneyasu ..... | B65H 5/34 271/227 |
| 2016/0159598 | A1 | 6/2016 | Yamane et al. | |

FOREIGN PATENT DOCUMENTS

| | | |
|---|---|---|
| JP | 9-175694 | 7/1997 |
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2008-239348 | 10/2008 |
| JP | 2010-149377 | 7/2010 |
| JP | 2011-098790 | 5/2011 |
| JP | 2014-088263 | 5/2014 |
| JP | 2014-193769 | 10/2014 |
| JP | 2016-024546 | 2/2016 |
| JP | 2016-044067 | 4/2016 |
| JP | 2016-188142 | 11/2016 |
| JP | 2017-142437 | 8/2017 |
| JP | 2017-202916 | 11/2017 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-229074, filed on Nov. 29, 2017, and 2018-173738, filed on Sep. 18, 2018, in the Japan Patent Office, the entire disclosure of each of which is hereby incorporated by reference herein.

BACKGROUND

Technical Field

This disclosure relates to a sheet conveying device and an image forming apparatus incorporating the sheet conveying device.

Related Art

Known sheet conveying devices that convey a sheet cause positional deviation such as angular displacement and lateral displacement of the sheet while the sheet is conveyed. For example, in an image forming apparatus that forms an image on a sheet, it is inconvenient that a position of an image to be formed on the sheet shifts from an ideal position due to positional deviation during the sheet conveyance.

In order to address this inconvenience, sheet conveying devices that convey a sheet while correcting the above-described positional deviation of the sheet have been developed. For example, a known sheet conveying device includes a driving roller and a nip forming roller, both of which are rotatably held on a carriage. Then, the sheet is fed to a nip portion formed between the driving roller and the nip forming roller while the driving roller and the nip forming roller are in rotation, so that the sheet is held and conveyed to the downstream side of a sheet conveying direction. Further, when the sheet is conveyed, the carriage moves in the width direction of the sheet while holding the driving roller and the nip forming roller. By so doing, the positional deviation of the sheet in the width direction can be corrected.

SUMMARY

At least one aspect of this disclosure provides a sheet conveying device including a pair of rotary bodies, a pair of downstream side sheet conveying bodies and a detector. The pair of rotary bodies is configured to convey a sheet and correct a positional deviation of the sheet. The pair of downstream side sheet conveying bodies is disposed downstream from the pair of rotary bodies in a sheet conveying direction and is configured to convey the sheet. The detector is configured to detect separation of the pair of rotary bodies. The pair of rotary bodies moves the sheet by moving from a home position on a sheet conveyance passage through which the sheet passes. The pair of rotary bodies moves to the home position while the pair of downstream side sheet conveying bodies is conveying the sheet, in response to detection of the separation of the pair of rotary bodies by the detector.

Further, at least one aspect of this disclosure provides an image forming apparatus including the above-described sheet conveying device.

Further, at least one aspect of this disclosure provides a sheet conveying device including a pair of rotary bodies, a pair of downstream side sheet conveying bodies and a detector. The pair of rotary bodies is configured to convey a sheet and correct a positional deviation of the sheet. The pair of downstream side sheet conveying bodies is disposed downstream from the pair of rotary bodies in a sheet conveying direction and is configured to convey the sheet. The detector is disposed in the vicinity of a downstream side of the pair of downstream side sheet conveying bodies and is configured to detect change of a detection state in response to detection of the sheet. The pair of rotary bodies moves the sheet by moving from a home position on a sheet conveyance passage through which the sheet passes. The pair of rotary bodies separates from the sheet after the sheet arrives the downstream side sheet conveying bodies. The pair of rotary bodies moves to the home position while the pair of downstream side sheet conveying bodies is conveying the sheet after the change of the detection state of the detector.

Further, at least one aspect of this disclosure provides an image forming apparatus including the above-described sheet conveying device.

Further, at least one aspect of this disclosure provides a sheet conveying device including a pair of rotary bodies, a pair of downstream side sheet conveying bodies, a detector and a controller. The pair of rotary bodies is configured to convey a sheet and correct a positional deviation of the sheet. The pair of downstream side sheet conveying bodies is disposed downstream from the pair of rotary bodies in a sheet conveying direction and is configured to convey the sheet. The detector is disposed in the vicinity of a downstream side of the pair of downstream side sheet conveying bodies in the sheet conveying direction and is configured to detect change of a detection state in response to detection of the sheet. The controller is configured to control an operation of the pair of rotary bodies. The controller causes the pair of rotary bodies to separate from the sheet after the sheet arrives the downstream side sheet conveying bodies. The controller causes the pair of rotary bodies to move to the home position while the pair of downstream side sheet conveying bodies is conveying the sheet after the change of the detection state of the detector.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
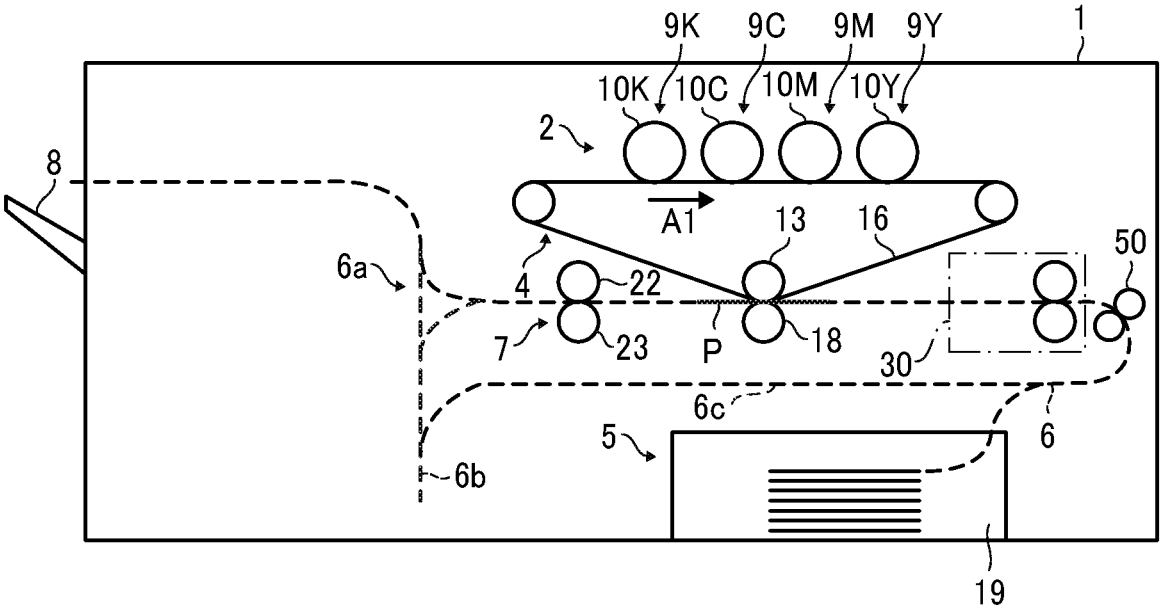
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device and an image forming apparatus incorporating the sheet conveying device, with reference to the following figures.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus 1 according to an embodiment of this disclosure.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 1 that is a color image forming apparatus includes an image forming device 2 to which four process units 9Y, 9M, 9C and 9K are detachably attached. The process units 9Y, 9M, 9C and 9K have respective configurations substantially identical to each other, except for colors of toners. Suffixes, which are Y, M, C and K, are used to indicate respective colors of toners (e.g., yellow, cyan, magenta, and black toners) for the process units 9Y, 9M, 9C and 9K. Hereinafter, the process units 9Y, 9M, 9C and 9K are occasionally referred to in a single form, for example, the process unit 9, for convenience.

To be more specific, each process unit 9 (i.e., the process units 9Y, 9M, 9C and 9K) includes a photoconductor drum 10 (i.e., photoconductor drums 10Y, 10M, 10C and 10K in FIG. 1), a charging roller (i.e., respective charging rollers for the process units 9Y, 9M, 9C and 9K), a developing device (i.e., respective developing devices for the process units 9Y, 9M, 9C and 9K), and a cleaning device (i.e., respective cleaning devices for the process units 9Y, 9M, 9C and 9K). The photoconductor drum 10 is a drum-shaped rotary body capable of carrying toner as developer on a surface thereof. The charging roller 11 uniformly charges the surface of the photoconductor drum 10. The developing device 12 supplies toner to the surface of the photoconductor drum 10.

An exposure device is disposed above the process units 9Y, 9M, 9C and 9K. The exposure device emits a laser light beam based on image data of an original document.

A transfer device 4 is disposed immediately below the image forming device 2 that includes the process units 9Y, 9M, 9C and 9K. The transfer device 4 includes a drive roller, a secondary transfer opposing roller 13, multiple tension rollers, an intermediate transfer belt 16, and primary transfer rollers. The intermediate transfer belt 16 that has an endless loop is wound around the rollers which are the drive roller, the secondary transfer opposing roller 13 and the multiple tension rollers with tension, so that the intermediate transfer belt 16 moves along with rotations of the rollers. The primary transfer roller (i.e., the respective primary transfer rollers for the process units 9Y, 9M, 9C and 9K) is disposed facing the photoconductor drum 10 (i.e., the photoconductor drums 10Y, 10M, 10C and 10K) of the process unit 9 (i.e., the process units 9Y, 9M, 9C and 9K) with the intermediate transfer belt 16 interposed therebetween. At the respective positions, the respective primary transfer rollers press against an inner circumferential surface (of the endless loop) of the intermediate transfer belt 16. Thus, respective primary transfer nip regions are formed at respective positions at which the photoconductor drums 10Y, 10M, 10C and 10K contact respective pressed portions of the intermediate transfer belt 16.

A secondary transfer roller 18 is disposed at a position facing the secondary transfer opposing roller 13 with the intermediate transfer belt 16 interposed therebetween. The secondary transfer roller 18 presses an outer circumferential surface of the intermediate transfer belt 16. Thus, a secondary transfer nip region is formed at a position at which the secondary transfer roller 18 and the intermediate transfer belt 16 contact each other.

The image forming apparatus 1 further includes a sheet feeding device 5 that is located at the lower part of the image forming apparatus 1. The sheet feeding device 5 includes a sheet feed tray 19 and a sheet feed roller. The sheet feed tray 19 functions as a sheet loader that contains a sheet P as a sheet. The sheet feed roller feeds the sheet P out from the sheet feed tray 19.

The image forming apparatus 1 further includes a sheet conveyance passage 6 through which the sheet P fed from the sheet feeding device 5 is conveyed. The sheet conveyance passage 6 is defined by multiple pairs of sheet conveying rollers disposed appropriately up to a sheet output portion 8.

Along the sheet conveyance passage 6, a sheet conveying device 30 is disposed downstream from the sheet feeding device 5 and upstream from the secondary transfer nip region in the sheet conveying direction. The sheet conveying device 30 corrects a positional deviation (e.g., an angular displacement and a lateral displacement) of the sheet P in the sheet conveyance passage 6 and conveys the sheet P toward the downstream side of the sheet conveying direction. It is to be noted that the term "positional deviation" indicates either one of or both of angular displacement of the sheet P and lateral displacement of the sheet P.

The image forming apparatus 1 further includes a fixing device 7. The fixing device 7 includes a fixing roller 22 and a pressure roller 23. The fixing roller 22 is heated by a heating source. The pressure roller 23 is capable of pressing the fixing roller 22.

The sheet output portion 8 is disposed at an extreme downstream side of the sheet conveyance passage 6 of the image forming apparatus 1.

A passage branching portion 6*a* is provided at a portion upstream from the sheet output portion 8 in the sheet conveyance passage 6. Separated from the sheet conveyance passage extending in a direction toward the sheet output portion 8, the sheet conveyance passage 6 is branched at the passage branching portion 6*a* to a sheet reverse passage 6*b* and a sheet reverse conveyance passage 6*c*.

Next, a description is given of basic operations of the image forming apparatus 1 with reference to FIG. 1.

As the image forming apparatus 1 starts a series of image forming operations, an electrostatic latent image is formed on a surface of the photoconductor drum 10 (i.e., the photoconductor drums 10Y, 10M, 10C and 10K) of the process unit 9 (i.e., the process units 9Y, 9M, 9C and 9K).

It is to be noted that image data exposed to the surface of the photoconductor drum 10 by the exposure device is single color image data of each color separated into each color information of yellow, magenta, cyan and black based on a desired full color image. After an electrostatic latent image is formed on the surface of the photoconductor drum 10, toner stored in the developing device is supplied to the surface of the photoconductor drum 10 by a drum-shaped developing roller. Thus, the electrostatic latent image is developed into a visible toner image (a developed image).

In the transfer device 4, the intermediate transfer belt 16 moves along with rotation of the drive roller in a direction indicated by arrow A1 in FIG. 1. A power source provided to the image forming apparatus 1 applies a constant voltage or a constant current control voltage having a polarity opposite the polarity of the toner, to the primary transfer roller (i.e., the respective primary transfer rollers for the process units 9Y, 9M, 9C and 9K). As a result, a transfer electric field is formed at the primary transfer nip region. Toner images of respective colors on the photoconductor drums 10Y, 10M, 10C and 10K are transferred one after another onto the surface of the intermediate transfer belt 16 in layers by the respective transfer electric fields formed at the respective primary transfer nip regions. Accordingly, the image forming device 2, the exposure device and the transfer device 4, for example, function as an image forming portion that forms an image on the sheet P.

By contrast, as the image forming apparatus 1 starts the image forming operation, the sheet feed roller of the sheet feeding device 5 rotates at the lower part of the image forming apparatus 1, so that the sheet P contained in the sheet feed tray 19 is fed to the sheet conveyance passage 6.

After being fed to the sheet conveyance passage 6, the sheet P is conveyed toward the downstream side of the sheet conveying direction by the sheet conveying device 30 and the multiple pairs of sheet conveying rollers provided along the sheet conveyance passage 6. While the sheet P is being conveyed in the sheet conveyance passage 6, the lateral displacement and angular displacement of the sheet P are corrected by the sheet conveying device 30. Thereafter, the sheet P is conveyed to the secondary transfer nip region formed between the secondary transfer roller 18 and the secondary transfer opposing roller 13. At this time, a transfer voltage having a polarity opposite the toner polarity of the toner image formed on the surface of the intermediate transfer belt 16 is applied to the sheet P and the transfer electric field is generated in the secondary transfer nip region. Due to the transfer electric field generated in the secondary transfer nip region, the toner image formed on the intermediate transfer belt 16 is transferred onto the sheet P collectively.

The sheet P onto which the toner image is transferred is conveyed to the fixing device 7. In the fixing device 7, heat and pressure are applied to the sheet P by the fixing roller 22 and the pressure roller 23, so that the toner image is fixed to the sheet P. Then, the sheet P to which the toner image has been fixed is separated from the fixing roller 22, conveyed to the sheet output portion 8 that is disposed downstream from the fixing roller 22 in the sheet conveying direction, and discharged to the outside of the image forming apparatus 1.

It is to be noted that, when a duplex printing is performed, after an image formed on a first face (a front face) of a sheet is fixed to the sheet P, the sheet travels from the passage branching portion 6*a* through the sheet reverse passage 6*b* and the sheet reverse conveyance passage 6*c*, and then returns to the sheet conveyance passage 6. Then, the sheet conveying device 30 conveys and corrects the positional deviation of the sheet P, the transfer device 4 transfers an image onto a second face (a back face) of the sheet P, and the fixing device 7 fixes the image to the second face of the sheet P. Thereafter, the sheet P is discharged to the sheet output portion 8.

The above description relates to a series of image forming operations for forming a full color image on a sheet P. In other image forming operations, a single color image can be formed by any one of the process units 9Y, 9M, 9C and 9K, or a composite color image of two or three colors can be formed by two or three of the process units 9Y, 9M, 9C and 9K.

Figure 2A:
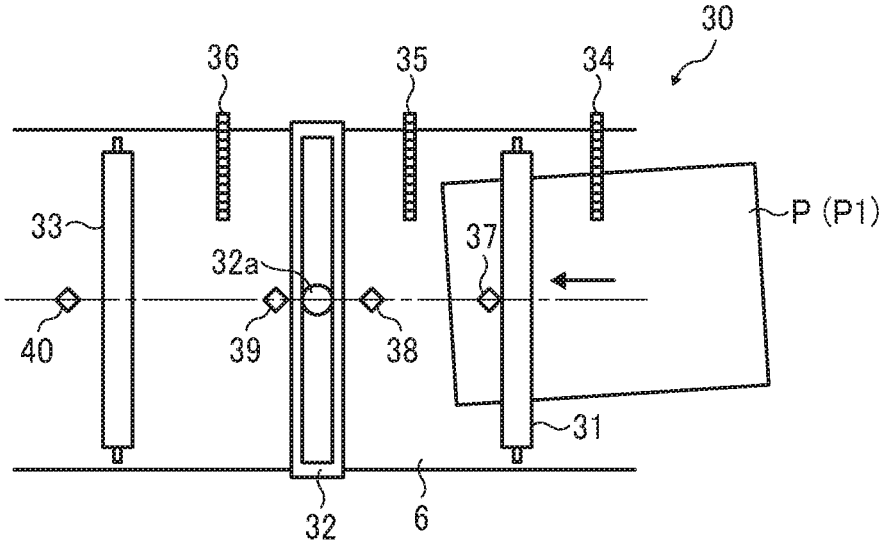
FIG. 2A is a plan view illustrating a sheet conveying device according to an embodiment of this disclosure.
Figure 2B:
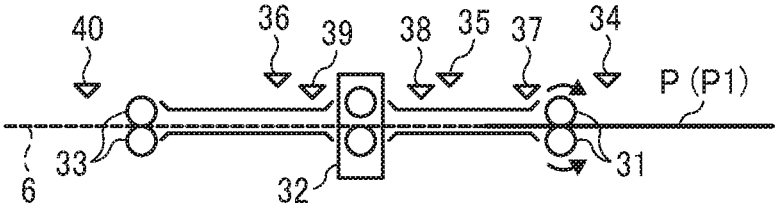
FIG. 2B is a side view illustrating the sheet conveying device of FIG. 2A.

As illustrated in FIGS. 2A and 2B, the sheet conveying device 30 according to the present embodiment includes a pair of sheet conveying rollers 31, a pair of sheet holding rollers 32, a pair of timing rollers 33, a first CIS 34, a second CIS 35, a third CIS 36, a first edge sensor 37, a second edge sensor 38, a third edge sensor 39 and a fourth edge sensor 40. The pair of sheet conveying rollers 31 functions as a pair of upstream side sheet conveying bodies. The pair of sheet holding rollers 32 functions as a pair of rotary bodies and a pair of sheet correcting bodies. The pair of timing rollers 33 functions as a pair of downstream side sheet conveying bodies. The first CIS 34 is a contact image sensor that functions as a sheet positional displacement detector to detect the sheet P. The second CIS 35 is a contact image sensor that functions as a sheet positional displacement detector to detect the sheet P. The third CIS 36 is a contact image sensor that functions as a sheet positional displacement detector to detect the sheet P. The first edge sensor 37 functions as a sheet detector. The second edge sensor 38 functions as an upstream side sheet detector. The third edge sensor 39 functions as a downstream side sheet detector. The fourth edge sensor 40 functions as a detector.

Hereinafter, the sheet conveying direction of the sheet P is also simply referred to as a "sheet conveying direction", and an upstream side of the sheet conveying direction and a downstream side of the sheet conveying direction are also simply referred to as an "upstream side" and a "downstream side". Further, the width direction of the sheet P is also simply referred to as a "width direction".

Each of the pair of sheet conveying rollers 31, the pair of sheet holding rollers 32 and the pair of timing rollers 33 includes sheet conveying rollers constructing a pair of rollers. Each of the pair of sheet conveying rollers 31, the pair of sheet holding rollers 32 and the pair of timing rollers 33 conveys the sheet P to the downstream side by rotating in a state in which the sheet P is held in the nip region between the sheet conveying rollers of each pair. It is to be noted that, in the sheet conveying direction of the sheet P, the pair of sheet conveying rollers 31, the pair of sheet holding rollers 32 and the pair of timing rollers 33 are arranged in this order from the upstream side toward the downstream side. The sheet P that is fed to the sheet conveying device 30 is conveyed toward the downstream side via the respective pairs of rollers in this order.

The pair of sheet holding rollers 32 is provided to be rotatable about a fulcrum 32*a* within a plane of sheet conveyance and movable in the width direction. Through these operations, the pair of sheet holding rollers 32 rotates the sheet P or moves the sheet P in the width direction while holding the sheet P, so as to correct the angular displacement of the sheet P or the lateral displacement of the sheet P. It is to be noted that rotations of the pair of sheet holding rollers 32 are hereinafter distinguished by describing differently. That is, the rotation of the pair of sheet holding rollers 32 to convey the sheet P is referred to as a "rotation" or a "rotation for sheet conveyance" and the rotation of the pair of sheet holding rollers 32 to correct the angular displacement of the sheet P is referred to as a "rotation within a plane of sheet conveyance".

Each of the first CIS 34, the second CIS 35 and the third CIS 36 is a contact image sensor that includes multiple photosensors, each including a light emitting element such as an LED (that is, a light emitting diode) and a light receiving element such as a photodiode. The multiple photosensors are aligned in the width direction of the sheet P.

The first edge sensor 37, the second edge sensor 38, the third edge sensor 39 and the fourth edge sensor 40 are sensors capable of detecting the front end position or the rear end position of the sheet P. Each of these sensors, for example, may be applied as a pair of photosensors having a light emitting element and a light receiving element. Each of the first edge sensor 37, the second edge sensor 38, the third edge sensor 39 and the fourth edge sensor 40 changes each detection state between a detected state when the sheet P is opposed to each edge sensor and a non-detected state when the sheet P is not opposed to each edge sensor.

The first edge sensor 37 is disposed at a portion close to the downstream side of the pair of sheet conveying rollers 31. The second edge sensor 38 is disposed at a portion close to the upstream side of the pair of sheet holding rollers 32. The third edge sensor 39 is disposed at a portion close to the downstream side of the pair of sheet holding rollers 32. The fourth edge sensor 40 is disposed at a portion close to the downstream side of the pair of sheet conveying rollers 31.

Figure 8A:
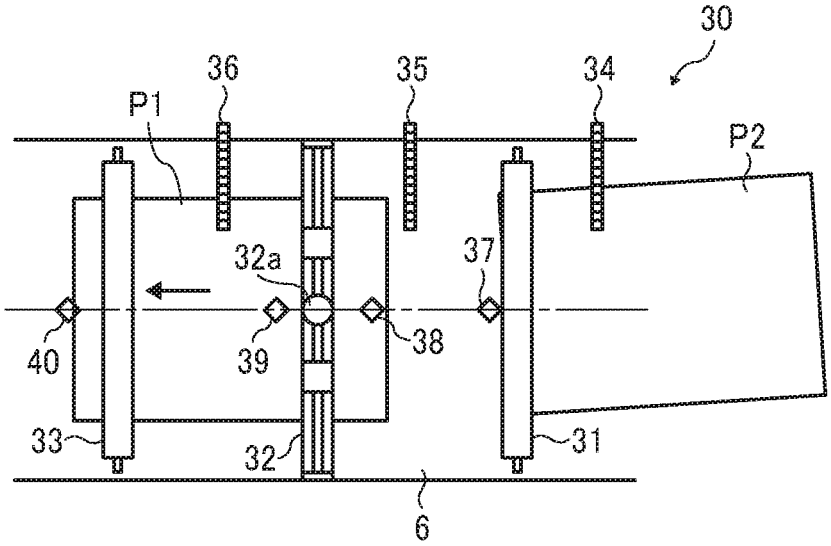
FIG. 8A is a plan view illustrating the sheet conveying device performing yet another subsequent step of the process of sheet conveyance.
Figure 8B:
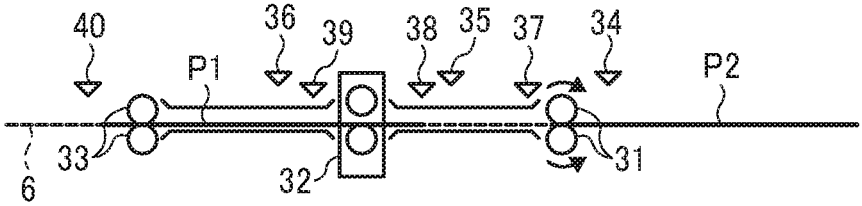
FIG. 8B is a side view illustrating the sheet conveying device of FIG. 8A.
Figure 9A:
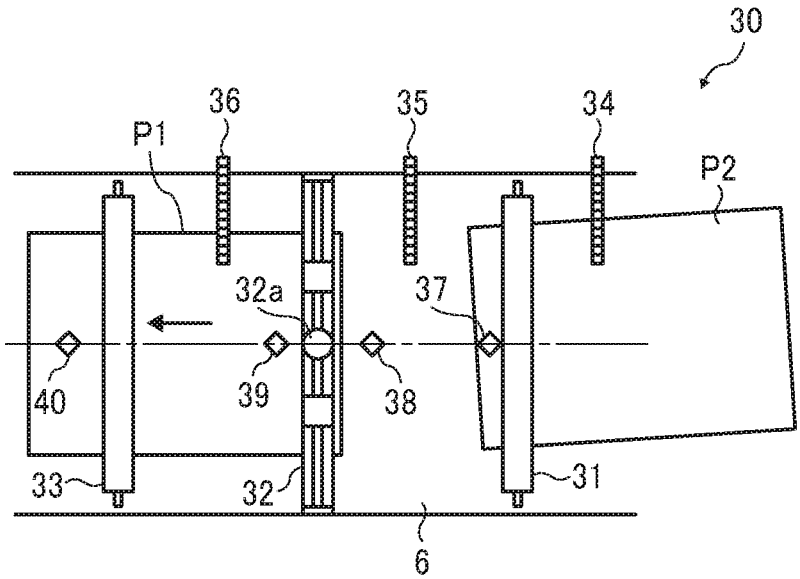
FIG. 9A is a plan view illustrating the sheet conveying device performing yet another subsequent step of the process of sheet conveyance.
Figure 9B:
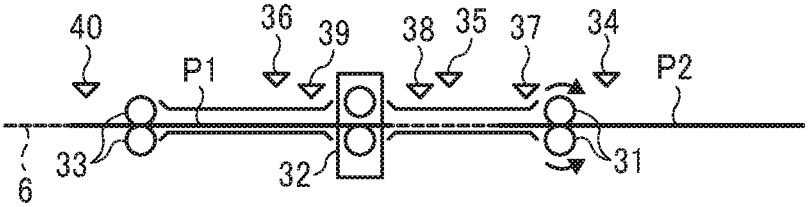
FIG. 9B is a side view illustrating the sheet conveying device of FIG. 9A.
Figure 10:
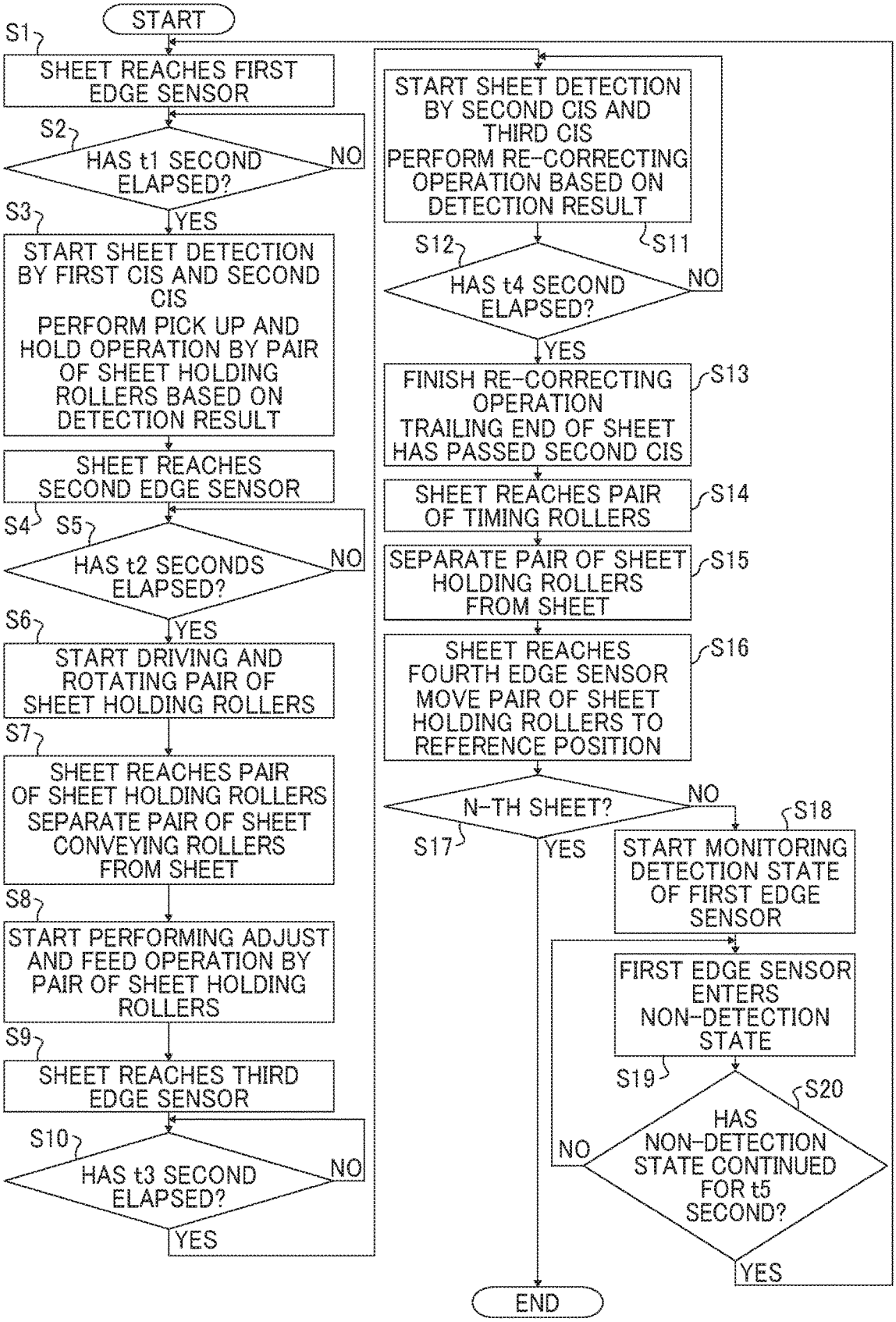
FIG. 10 is a flowchart illustrating steps of the process of sheet conveyance by the sheet conveying device.
Figure 11:
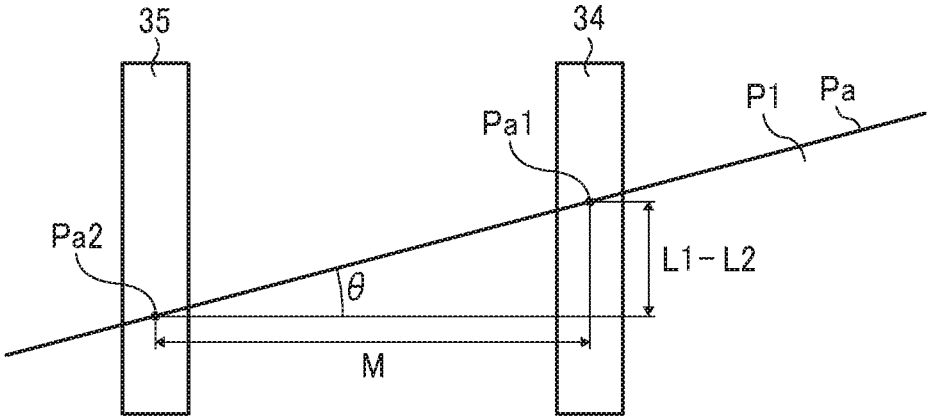
FIG. 11 is a diagram illustrating a method of calculating a positional deviation amount of a sheet by CISs.

Next, a description is given of operations to be performed when sheets are continuously fed to the sheet conveying device 30, with reference to FIGS. 2A through 11. FIGS. 2A through 9B are diagrams illustrating the operations, FIG. 10 is a flowchart and FIG. 11 is a diagram illustrating a method of calculating a positional deviation amount of the sheet P by the CISs.

First, as illustrated in FIGS. 2A and 2B, a sheet P1 that has been fed to the sheet conveying device 30 reaches the position of the first CIS 34 and then the position of the pair of sheet conveying rollers 31. Then, the sheet P1 is conveyed toward the downstream side while being held by the pair of sheet conveying rollers 31. At this time, an upstream side sheet conveying body of the sheet conveying device 30 (i.e., a pair of upstream side rollers 50 in FIG. 1 in the present embodiment) separates from the sheet P1.

As illustrated in FIG. 2B, the pair of sheet holding rollers 32 that is disposed downstream from the pair of upstream side rollers 50 is separated from the sheet conveyance passage 6. The pair of sheet holding rollers 32 includes an upper roller and a lower roller. In the present embodiment, the upper roller moves to separate from the lower roller while the lower roller does not move. In the present embodiment, a state in which the upstream side pair of rollers alone separates from the sheet conveyance passage 6 is referred to as "separation of the pair of sheet holding rollers 32", for example. Further, the pair of sheet holding rollers 32 is disposed at a reference position or a home position. Hereinafter, referred to as a "home position" in this disclosure. The home position of the pair of sheet holding rollers 32 is a position where the pair of sheet holding rollers 32 is disposed facing the sheet conveyance passage 6 along the sheet conveyance passage 6, as illustrated in FIG. 2A.

Then, as illustrated in FIGS. 2A and 2B, when the sheet P1 reaches the first edge sensor 37, the arrival of the sheet P1 is detected by the first edge sensor 37 (step S1 in FIG. 10).

Figure 3A:
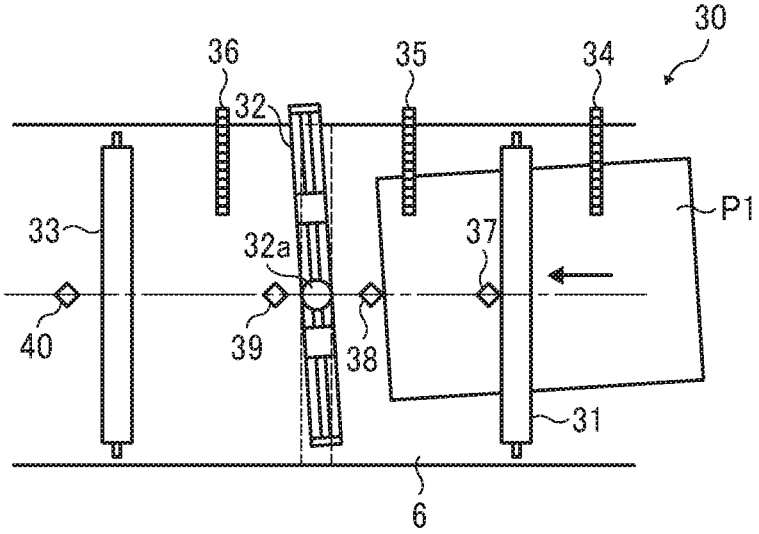
FIG. 3A is a plan view illustrating the sheet conveying device performing a step of a process of sheet conveyance.
Figure 3B:
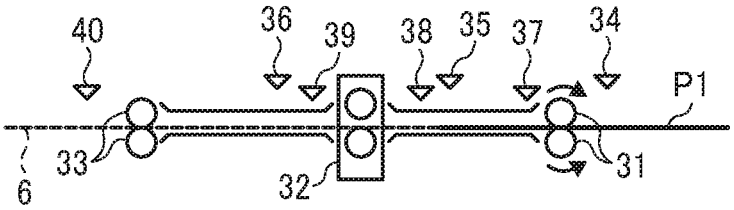
FIG. 3B is a side view illustrating the sheet conveying device of FIG. 3A.

After a certain time has elapsed since step S1, the sheet P1 reaches the second CIS 35, as illustrated in FIGS. 3A and 3B.

In the present embodiment, after a t1 second (also referred to as a "time t1") has elapsed since the detection of the leading end of the sheet P1 by the first edge sensor 37, the first CIS 34 and the second CIS 35 start detection of the sheet P1 in step S1 (step S2). The time t1 is set based on the timing at which the sheet P1 reaches the second CIS 35. Specifically, the time t1 is set based on the distance between the first edge sensor 37 and the second CIS 35 and the conveying speed of the sheet P1.

Then, angular and lateral displacement amounts of the sheet P1 are calculated based on the detection results of the sheet P1 obtained by the first CIS 34 and the second CIS 35. Consequently, the pair of sheet holding rollers 32 performs a pick up and hold operation based on the angular and lateral displacement amounts of the sheet P1 (step S3). The pick up and hold operation is an operation in which the pair of sheet holding rollers 32 moves by the angular displacement amount in a rotational direction of the sheet P1 and the lateral displacement amount in the width direction. In other words, in the pick up and hold operation, the pair of sheet holding rollers 32 moves to pick up the sheet P1 having angular and lateral displacements in a state in which the pair of sheet holding rollers 32 faces the sheet P1 in a normal direction.

A description is given of an example of a method of calculating the angular displacement amount and the lateral displacement amount of the sheet P1 based on the detection results obtained by the first CIS 34 and the second CIS 35, with reference to FIG. 11.

As illustrated in FIG. 11, the first CIS 34 and the second CIS 35 read and detect the boundary of a sheet area and a non-sheet area of the sheet P1, and therefore the position of a side end Pa of the sheet P1 in the width direction is detected. Specifically, the first CIS 34 detects a lateral position L1 of a point Pa1 and the second CIS 35 detects a lateral position L2 of a point Pa2. Then, the lateral displacement amount of the sheet P1 is obtained by averaging, for example, the lateral position L1 and the lateral position L2. Further, a slope angle (i.e., the angular displacement amount) θ of the sheet P1 is expressed by the following Equation 1 using a distance M of the first CIS 34 and the second CIS 35 in the sheet conveying direction, $$\text{TAN}\ \theta=(L1-L2)/M \qquad \text{Equation 1.}$$

By using this Equation 1, the angular displacement amount θ of the sheet P1 is obtained. The angular displacement amount of the sheet P1 is calculated by a sheet position recognition unit 61 included in a controller 60 (see FIG. 12), which is described below.

As described above, the timing at which the sheet P1 reaches the second CIS 35 is estimated by the detecting operation of the first edge sensor 37, and therefore the first CIS 34 and the second CIS 35 start the detecting operations before the sheet P1 reaches the second CIS 35. Therefore, any extra detecting operation by these CISs is reduced, waste energy consumption can be reduced, and the lifetime of the CISs can be increased. Further, the detecting operation of the first edge sensor 37 serves as a starting point for starting the correcting operation of the sheet P1. The correcting operation (the primary correction) of the sheet P1 corresponds to a series of operations in which the first CIS 34 and the second CIS 35 detect the position of the sheet P1 and calculate the angular and lateral displacement amounts of the sheet P1, the pair of sheet holding rollers 32 performs the pick up and hold operation after the detection and calculation by the first CIS 34 and the second CIS 35, and then the pair of sheet holding rollers 32 performs an adjustment and feed operation. Details of the adjustment and feed operation is described below.

Figure 4A:
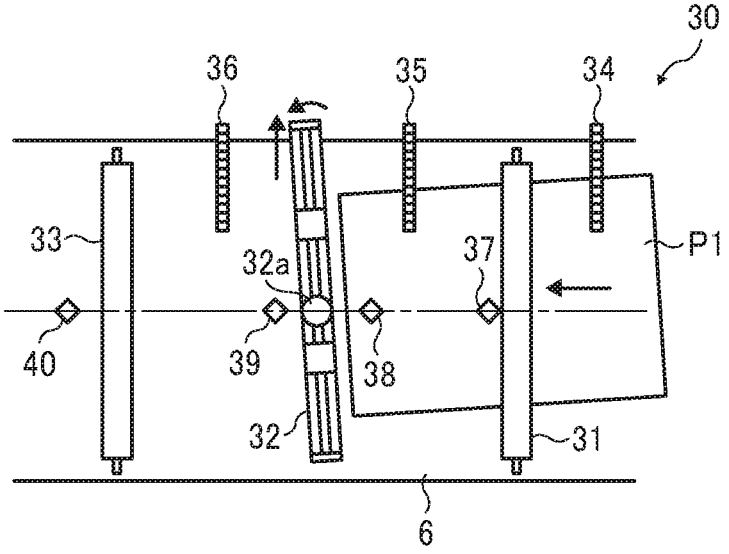
FIG. 4A is a plan view illustrating the sheet conveying device performing a subsequent step of the process of sheet conveyance.
Figure 4B:
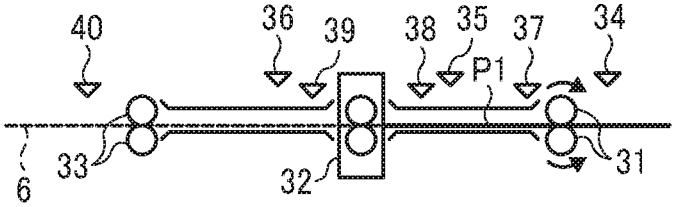
FIG. 4B is a side view illustrating the sheet conveying device of FIG. 4A.

As the sheet P1 is further conveyed, the leading end of the sheet P1 reaches the second edge sensor 38, as illustrated in FIGS. 4A and 4B (step S4). Due to the detecting operation of the second edge sensor 38, the rollers constructing the pair of sheet holding rollers 32 start to contact each other, changing from the separated state to the pressed state.

Figure 5A:
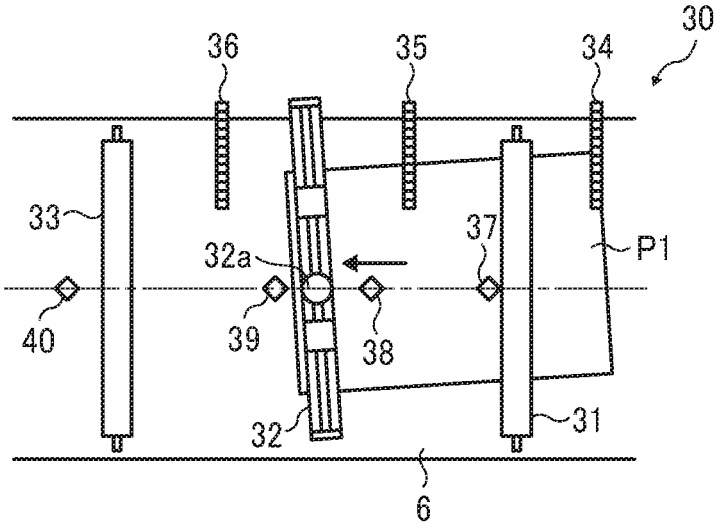
FIG. 5A is a plan view illustrating the sheet conveying device performing yet another subsequent step of the process of sheet conveyance.
Figure 5B:
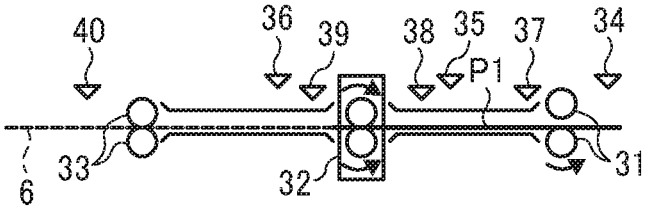
FIG. 5B is a side view illustrating the sheet conveying device of FIG. 5A.

As illustrated in FIGS. 5A and 5B, after a certain period of time has elapsed from the arrival of the sheet P1 to the second edge sensor 38, the sheet P1 reaches the pair of sheet holding rollers 32.

In the present embodiment, after a t2 second (hereinafter, also referred to as a "time t2") has elapsed from the detection of the sheet P1 by the second edge sensor 38 (step S5), the pair of sheet holding rollers 32 starts rotating (step S6). Thereafter, when the sheet P1 reaches the pair of sheet holding rollers 32 and becomes ready to be conveyed by the pair of sheet holding rollers 32, the pair of sheet conveying rollers 31 starts to separate from the sheet conveyance passage 6 and the sheet P1 (step S7). The time t2 is set to a timing before the sheet P1 reaches the pair of sheet holding rollers 32 and is determined based on a distance between the second edge sensor 38 and the pair of sheet holding rollers 32 and a conveying speed of the sheet P1. Further, before the sheet P1 reaches the pair of sheet holding rollers 32, the pair of sheet holding rollers 32 has been changed to the pressed state.

As described above, according to the detecting operation of the second edge sensor 38, the timing at which the sheet P1 reaches the pair of sheet holding rollers 32 is estimated. Then, in accordance with this timing, the rollers of the pair of sheet holding rollers 32 are pressed and rotated. By so doing, before the sheet P1 reaches the pair of sheet holding rollers 32, the pair of sheet holding rollers 32 is changed to a state in which the pair of sheet holding rollers 32 holds and conveys the sheet P1.

Figure 6A:
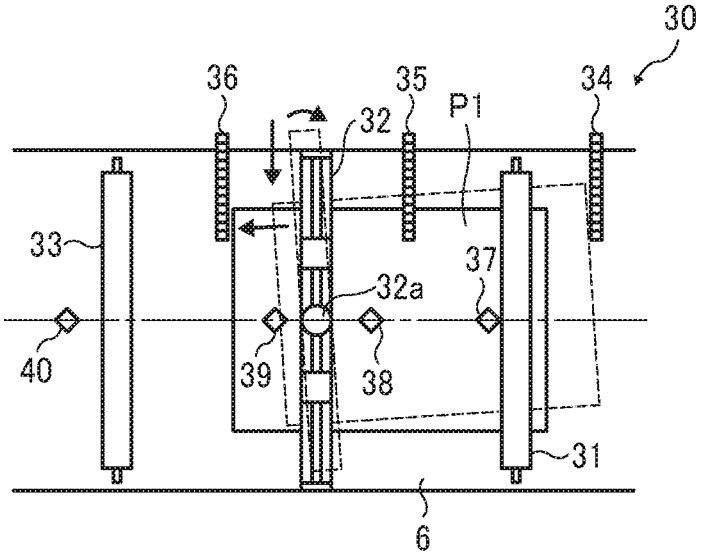
FIG. 6A is a plan view illustrating the sheet conveying device performing yet another subsequent step of the process of sheet conveyance.
Figure 6B:
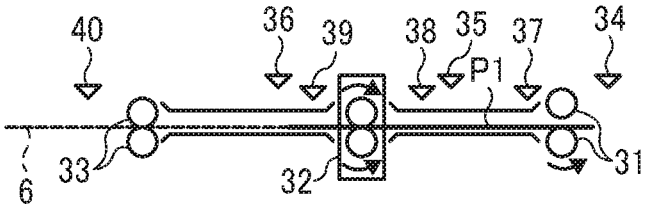
FIG. 6B is a side view illustrating the sheet conveying device of FIG. 6A.

Further, as illustrated in FIGS. 6A and 6B, after the pair of sheet conveying rollers 31 has separated from the sheet P1, the pair of sheet holding rollers 32 performs the adjustment and feed operation while holding and conveying the sheet P1, so that the angular and lateral displacements of the sheet P1 is corrected (step S8). The adjustment and feed operation of the pair of sheet holding rollers 32 is an operation in which the pair of sheet holding rollers 32 moves in the rotational direction and the width direction of the sheet P1 within a plane of sheet conveyance of the sheet P1 by the angular and lateral displacement amounts of the sheet P1 while the sheet P1 is being conveyed, so as to correct the angular and lateral displacements of the sheet P1. Since the pair of sheet holding rollers 32 is previously shifted by the angular and lateral displacement amounts of the sheet P1 due to the pick up and hold operation, the pair of sheet holding rollers 32 after the adjustment and feed operation returns to a home position. That is, the pair of sheet holding rollers 32 moves from a position indicated with a broken line in FIG. 6A to a position indicated with a solid line in FIG. 6A). Thus, with the detecting operation of the second edge sensor 38 acting as the starting point, the pair of sheet holding rollers 32 starts the sheet conveying operation and the correcting operation of the sheet P1.

Figure 7A:
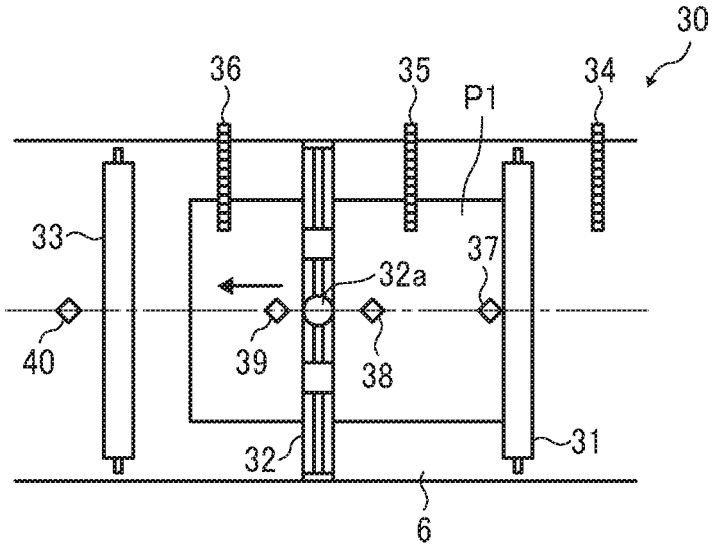
FIG. 7A is a plan view illustrating the sheet conveying device performing yet another subsequent step of the process of sheet conveyance.
Figure 7B:
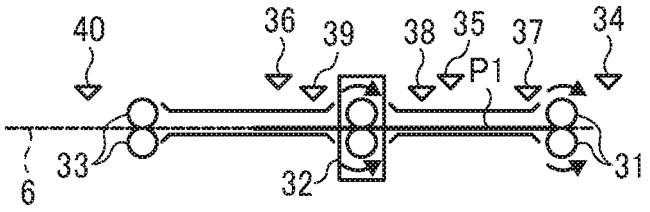
FIG. 7B is a side view illustrating the sheet conveying device of FIG. 7A.

It is to be noted that, in order to prepare another sheet conveyance for a subsequent sheet, the pair of sheet conveying rollers 31 changes the state again after the adjustment and feed operation, to the pressed state again at a predetermined timing (see FIG. 7B).

During the process of the adjustment and feed operation or after completion of the adjustment and feed operation, the sheet P1 reaches the third edge sensor 39 and the third edge sensor 39 detects the arrival of the sheet P1 (step S9).

Then, as illustrated in FIGS. 7A and 7B, after a certain period of time has elapsed since the arrival of the sheet P1 to the third edge sensor 39 in step S9, the sheet P1 reaches the third CIS 36. Before the sheet P1 reaches the third CIS 36, the pair of sheet holding rollers 32 completes the adjustment and feed operation. Accordingly, the first correcting operation (the primary correction) of the sheet P1 is completed.

In the present embodiment, after a t3 second (hereinafter, also referred to as a "time t3") has elapsed from the arrival of the sheet P1 to the third edge sensor 39 (step S10), the second CIS 35 and the third CIS 36 start the detecting operations (step S11). By taking into consideration of the distance between the third edge sensor 39 and the third CIS 36 and the conveying speed of the sheet P1, the time t3 is set to a timing before the sheet P1 is conveyed to the third CIS 36.

Accordingly, by providing the third edge sensor 39, the timing at which the sheet P1 reaches the third CIS 36 can be estimated, and the third CIS 36 can start the detecting operation of the sheet P1 before the sheet P1 reaches the third CIS 36.

After the angular and lateral displacements of the sheet P1 have been corrected by the adjustment and feed operation, the second CIS 35 and the third CIS 36 detect the position of the sheet P1 again, so that the angular and lateral displacement amounts of the sheet P1 is calculated. Then, the pair of sheet holding rollers 32 corrects the angular and lateral displacements of the sheet P1 again. It is to be noted that a method of calculating the angular and lateral displacement amounts of the sheet P1 based on the detection results obtained by the second CIS 35 and the third CIS 36 is the same method as the above-described method of calculating the angular and lateral displacement amounts of the sheet P1 based on the detection results obtained by the first CIS 34 and the second CIS 35.

For a t4 second (hereinafter, also referred to as a "time t4") from the arrival of the sheet P1 to the third edge sensor 39, the second CIS 35 and the third CIS 36 repeat the detecting operations and the pair of sheet holding rollers 32 repeats the correcting operation. That is, the detection results obtained by the second CIS 35 and the third CIS 36 are continuously fed back to the pair of sheet holding rollers 32, and the angular and lateral displacements of the sheet P1 are corrected with high accuracy (steps S1 and S12). Hereinafter, this correcting operation is referred to as a "recorrecting operation".

In addition, the pair of sheet holding rollers 32 that has returned to the home position after the adjustment and feed operation moves from the home position by the correction amount of the sheet P1 according to the recorrecting operation, to a position different from the home position.

This recorrecting operation is performed until the trailing end of the sheet P1 passes by the second CIS 35 (step S13). As the sheet P1 is conveyed further to the downstream side of the sheet conveying direction, the sheet P1 reaches the pair of timing rollers 33 (step S14).

Then, the sheet P1 is held by the pair of timing rollers 33 to be ready for sheet conveyance, and the pair of sheet holding rollers 32 stops the rotations and separates from the sheet P1 (step S15). Rotation stoppage and separation of the rollers of the pair of sheet holding rollers 32 are performed at a timing different from the detection by the sensors. Specifically, after starting rotation in step S6 and making a predetermined number of rotations, the pair of sheet holding rollers 32 automatically stops the rotations and separates from the sheet P1.

It is to be noted that the above-described predetermined number of rotations of the pair of sheet holding rollers 32 is set to a value at which the rotation of the pair of sheet holding rollers 32 is stopped after the sheet P is held by the pair of timing rollers 33. That is, the value of the number of rotations of the pair of sheet holding rollers 32 is set to an amount by which the sheet P reaches the pair of timing rollers 33, based on the distance between the pair of sheet holding rollers 32 and the pair of timing rollers 33.

The sheet P1 is conveyed by the pair of timing rollers 33 and reaches the fourth edge sensor 40, as illustrated in FIGS. 8A and 8B (step S16). Thereafter, the timing of the sheet P1 is measured by the pair of timing rollers 33. The sheet P1 is further conveyed to the downstream side of the sheet conveying direction toward the secondary transfer position. Accordingly, the sheet conveying device 30 completes conveyance of the sheet P1.

At this time, if the number of N sheets is specified to be printed in a print job of the image forming apparatus 1, it is determined whether or not the sheet P1 is the Nth sheet (step S17). When the sheet P is the Nth sheet (YES in step S17), the sheet conveyance of the sheet conveying device 30 completes the sheet conveyance.

By contrast, when the sheet P1 is not the Nth sheet (NO in step S17), the sheet conveying device 30 changes the operation to convey a subsequent sheet P2. As illustrated in FIGS. 8A and 8B, the subsequent sheet P2, which is a sheet to be printed after the sheet P1, is conveyed to the upstream side of the sheet conveying device 30.

When the subsequent sheet P2 is conveyed to the sheet conveying device 30 and the pair of sheet holding rollers 32 performs the pick up and hold operation of the subsequent sheet P2 again (see step S3), the amount of movement of the pair of sheet holding rollers 32 for the pick up and hold operation is calculated as an amount of movement of the pair of sheet holding rollers 32 from the home position. Therefore, when starting the pick up and hold operation for the subsequent sheet P2, the pair of sheet holding rollers 32 is to be located at the home position. In this regard, as described above, since the pair of sheet holding rollers 32 is moved from the home position due to the recorrecting operation, the pair of sheet holding rollers 32 is located at a position different from the home position after completion of the recorrecting operation of the sheet P1. Therefore, the pair of sheet holding rollers 32 is to be returned to the home position before receiving the subsequent sheet P2.

By contrast, in a case in which the pair of sheet holding rollers 32 starts moving to the home position while conveying the preceding sheet P1, a positional deviation occurs to the sheet P1 by the amount of movement of the pair of sheet holding rollers 32 toward the home position. Therefore, the pair of sheet holding rollers 32 is to start moving to the home position after the preceding sheet P1 is conveyed to and accepted by the pair of rollers disposed at the downstream side (i.e., the pair of timing rollers 33 in the present embodiment).

As described above, the movement of the pair of sheet holding rollers 32 to the home position is to be performed during the period of time from completion of the sheet conveyance of the preceding sheet P1 to arrival of the subsequent sheet P2. In the present embodiment, the fourth edge sensor 40 is used to detect a timing to start the pair of sheet holding rollers 32 to moving to the home position. That is, the fourth edge sensor 40 is disposed at a portion close to the downstream side of the pair of timing rollers 33. Therefore, when the fourth edge sensor 40 detects the sheet P1, the sheet P1 has already been held and conveyed by the pair of timing rollers 33 and the pair of sheet holding rollers 32 has been separated from the sheet P1 (step S15). Accordingly, by starting movement of the pair of sheet holding rollers 32 to the home position after detection of the sheet P1 by the fourth edge sensor 40, the pair of sheet holding rollers 32 can be moved to the home position without causing any angular and lateral displacements of the preceding sheet P1.

As described above, by providing the fourth edge sensor 40, a timing at which the pair of sheet holding rollers 32 moves to the home position is determined. In particular, the fourth edge sensor 40 detects the timing immediately after the pair of sheet holding rollers 32 has separated from the sheet P1. According to this operation, the pair of sheet holding rollers 32 can return to the home position more quickly. Specifically, while the pair of timing rollers 33, which is the pair of downstream side rollers disposed downstream from the pair of sheet holding rollers 32, is holding and conveying the sheet P1, the pair of sheet holding rollers 32 starts moving to the home position. Therefore, even in an image forming apparatus that performs a high-speed printing with relatively short intervals of adjacent sheets to be printed, the pair of sheet holding rollers 32 can be returned to the home position before a subsequent sheet is conveyed. In other words, the pair of sheet holding rollers 32 conveys sheets to be printed at high speed while correcting the angular and lateral displacements of each sheet. Therefore, the sheet conveying device having the pair of sheet holding rollers 32 is applicable to an image forming apparatus that performs high-speed printing.

It is to be noted that, in the present embodiment, in order to detect separation of the pair of sheet holding rollers 32 from the sheet P1, a separation timing of the pair of sheet holding rollers 32 is detected indirectly by detecting the arrival of the sheet P1 to the fourth edge sensor 40, which is performed immediately after the separation of the pair of sheet holding rollers 32 from the sheet P1. As described above, the timing at which the pair of sheet holding rollers 32 starts to move to the home position is not limited to the case in which the direct detection of separation of the pair of sheet holding rollers 32 acts as a starting time. For example, the separation of the pair of sheet holding rollers 32 may be detected indirectly by detecting a substantially same timing as the above-described timing or a timing of a specified operation performed after the above-described timing. Accordingly, the timing detected indirectly as above may act as a starting time at which the pair of sheet holding rollers 32 starts to move to the home position.

It is to be noted that, as an example of a direct detection of the timing thereof, a separation detecting mechanism may be provided to the pair of sheet holding rollers 32 instead of the fourth edge sensor 40, so as to cause the pair of sheet holding rollers 32 to move to the home position according to the detecting operation by the separation detecting mechanism.

Consequently, as illustrated in FIGS. 9A and 9B, when the subsequent sheet P2 that has been newly conveyed reaches the first edge sensor 37, the first CIS 34 and the second CIS 35 start detection of the subsequent sheet P2, thereby starting the correcting operation of the subsequent sheet P2 (steps S1 to S3).

In the present embodiment, as described above, a new correcting operation is set to start after the fourth edge sensor 40 has detected the sheet P1 and then the first edge sensor 37 has detected a new subsequent sheet P2. However, in this case, it is to be determined whether the first edge sensor 37 has detected the preceding sheet P1 or the new subsequent sheet P2. If the preceding sheet P1 is mistakenly detected as the new subsequent sheet P2, the pair of sheet holding rollers 32 becomes ready to move to the home position during the conveying operation of the sheet P1 or the pair of sheet holding rollers 32 has not yet completed the pick up and hold operation even when a new subsequent sheet P2 is conveyed. These inconveniences may cause erroneous operations, which may lead to angular and lateral displacements of the sheet.

As a detailed method of determining that the preceding sheet P1 is replaced to the new subsequent sheet P2 according to the detection state of the first edge sensor 37, for example, when the first edge sensor 37 enters the detected state while the preceding sheet P1 is being conveyed, changes to the non-detected state, and changes to the detected state again, it is determined that the new subsequent sheet P2 is conveyed. That is, the non-detected state is judged as a state in which the first edge sensor 37 detects an interval between the preceding sheet P1 and the subsequent sheet P2, and the detected state for the second time after the non-detected state is judged as a state in which the new subsequent sheet P2 is conveyed and detected.

However, this method causes erroneous detection in the following cases. That is, when a punch hole that functions as a punching opening is formed in the sheet P1, the state temporarily enters the non-detected state while the punch hole passes by the first edge sensor 37.

In addition, in a case in which the sheet P1 has an image previously printed thereon, the first edge sensor 37 cannot recognize a black image portion as a sheet area, for example. Consequently, the state may temporarily enter the non-detected state. As described above, there is a case in which the state temporarily enters the non-detected state even while the sheet P1 is being conveyed. If the above-described method is employed, it is highly likely to be misjudged that the sheet P1 has already passed, and therefore the following detection of the sheet P1 is judged as the detection of the subsequent sheet P2.

In view of the circumstances as described above, in the present embodiment, it is determined that whether or not the non-detected state of the first edge sensor 37 indicates an interval of two adjacent sheets, as described in steps S18 to S20 in the flowchart of FIG. 10. Specifically, after detection by the fourth edge sensor 40 (after step S16), a controller 60 starts monitoring of the detection state of the first edge sensor 37 (step S18). Then, when the detection state of the first edge sensor 37 is changed from the detected state to the non-detected state (step S19), if the non-detected state continues for a t5 second (hereinafter, also referred to as a "time t5"), it is determined that the interval of two adjacent sheets is detected, and the operation moves to the correcting operation for the subsequent sheet P2.

If the non-detected state does not continue for the t5 second (the time t5), the first edge sensor 37 continues the detecting operation (step S20) without proceeding to the correcting operation for the subsequent sheet P2.

The above-described time t5 is a value provided for determining whether or not the non-detected state is a time for detecting the punch hole. Specifically, when the longitudinal length of an assumed punch hole in the sheet conveying direction (i.e., the diameter of the punch hole) is indicated as "d [mm]" and the conveying speed of the sheet is indicated as "v [mm/s]", a time at which the punch hole passes by the first edge sensor 37 can be expressed as "d/v [s]". That is, when the non-detected state exceeds d/v [s], the result is expressed as "t×v>d". Therefore, it is determined that the first edge sensor 37 has detected a non-detected portion having a width greater than the punch hole. As a result, it is determined that the non-detected portion is not a punch hole but is an interval between two adjacent sheets. Therefore, by setting the value of the time t5 to a value greater than d/v [s], detection of the interval of two adjacent sheets and detection of a punch hole are distinguished.

Further, when an assumed sheet interval length is indicated as "L [mm]", the value of the time t5 is to be set to a value smaller than L/v [s]. That is, the time t5 is set so that "t×v" is not a greater value than the sheet interval. As described above, the time t5 is set to an arbitrary value that is greater than "d/v [s]" and smaller than "L/v [s]".

It is to be noted that, with the method according to the present embodiment, even when the black image passes by the first edge sensor 37 and the state is indicated as the non-detected state, erroneous detection can be prevented. That is, even when a sheet has a black image printed thereon, the first edge sensor 37 can detect large part of the sheet as part of a sheet, and the state temporarily enters the non-detected state. Therefore, even if the first edge sensor 37 is in the non-detected state when a sheet having a black image printed thereon is passing, the duration of the non-detected state of the first edge sensor 37 is not beyond the t5 second (or the time t5). Therefore, with the above-described method according to the present embodiment, the non-detected state due to the passage of a sheet having a black image and the non-detected state due to the interval of sheets can be distinguished.

An assumed size "d [mm]" of the punch hole is in a range from 5.5 mm to 6.5 mm according to JIS S 6041. However, in a case in which there is a hole in a sheet other than the punch hole, the distance "d" is set according to the length of the hole in the sheet conveying direction (i.e., the length of the assumed punch hole in the sheet conveying direction), so that the above-described time t5 can be set.

When it is determined that the non-detected state detected by the first edge sensor 37 is the interval of sheets, in a case in which the state is changed to a detected state after the non-detected state, it is determined that the first edge sensor 37 has detected the subsequent sheet P2, and the process precedes to the sheet conveyance of the subsequent sheet P2 (shifting to step S2). By repeating the above-described operations, the sheet conveying device 30 conveys the N sheets and corrects the angular and lateral displacements of each sheet.

As described above, the sheet P is conveyed to the secondary transfer position in a state in which the positional deviation relative to the sheet conveyance passage of each sheet is corrected, and therefore the image is formed at an appropriate position on the sheet P. In other words, the absolute positional deviation of an image to be formed on the surface of the sheet P can be corrected.

Further, when the duplex printing is performed to the sheet P, the sheet P that is reversed while passing the sheet reverse passage 6*b* and the sheet reverse conveyance passage 6*c* (see FIG. 1) is conveyed to the sheet conveying device 30, so that the position of the sheet P is corrected again. Accordingly, the position of the image to be formed on the back face of the sheet P.

As described above, the sheet conveying device 30 performs the correcting operations for the positions of respective images on the front and back faces of the sheet P before forming the respective images on the front and back faces of the sheet P. By so doing, the relative positional deviation of the image formed on the front face of the sheet P and the image formed on the back face of the sheet P is also eliminated.

Figure 12:
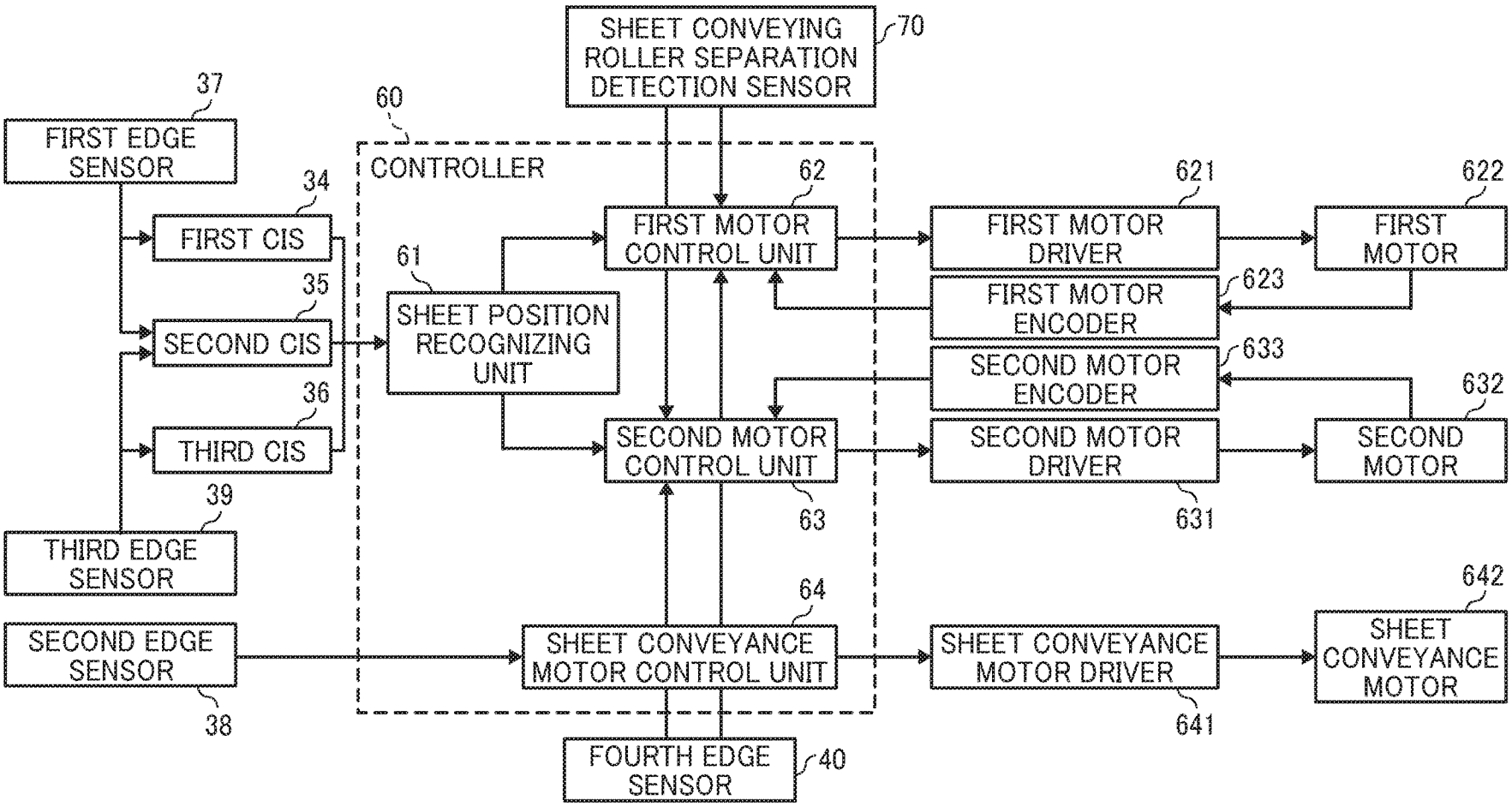
FIG. 12 is a block diagram illustrating a configuration of a controller that controls each operation of the sheet conveying device.

FIG. 12 is a block diagram illustrating a configuration of the controller 60 that controls each operation of the sheet conveying device 30.

As illustrated in FIG. 12, the controller 60 includes a sheet position recognition unit 61, a first motor control unit 62, a second motor control unit 63, and a sheet conveyance motor control unit 64.

The sheet position recognition unit 61 calculates the angular displacement amount of the sheet P and the lateral displacement amount of the sheet P based on detection data received from each CIS. Then, the sheet position recognition unit 61 sends information of the angular and lateral displacement amounts of the sheet P to the first motor control unit 62 and the second motor control unit 63.

The first motor control unit 62 and the second motor control unit 63 are units to control each movement of the pair of sheet holding rollers 32 based on the information on the angular and lateral displacement amounts of the sheet P sent from the sheet position recognition unit 61.

The first motor control unit 62 controls rotation of the pair of sheet holding rollers 32 within a plane of sheet conveyance. A first motor driver 621 drives a first motor 622 according to the signal sent from the first motor control unit 62 to rotate the pair of sheet holding rollers 32 within a plane of sheet conveyance. Then, a first motor encoder 623 detects the amount of rotations of the pair of sheet holding rollers 32 within a plane of sheet conveyance.

The second motor control unit 63 controls movement of the pair of sheet holding rollers 32 in the width direction. A second motor driver 631 drives a second motor 632 according to a signal sent from the second motor control unit 63 to move the pair of sheet holding rollers 32 in the width direction. Then, a second motor encoder 633 detects the amount of movement of the pair of sheet holding rollers 32 in the width direction.

The first motor 622 and the second motor 632 are driven when the pair of sheet holding rollers 32 performs the pick up and hold operation (step S3 in FIG. 10), performs the adjustment and feed operation (step S8), performs the recorrecting operation (step S11), and returns to the home position (step S16).

As described above, the detecting operations performed by the first CIS 34 and the second CIS 35 are performed at the t1 second (i.e., the time t1) after the first edge sensor 37 has detected a new sheet P (see steps S1 to S3). Based on the detection results, the pair of sheet holding rollers 32 performs the pick up and hold operation and the adjustment and feed operation.

Further, the detecting operations by the second CIS 35 and the third CIS 36 are performed at the t3 second (i.e., the time t3) after the third edge sensor 39 has detected the sheet P (steps S9 to S11). Based on the detection results, the pair of sheet holding rollers 32 performs the recorrecting operation.

When the pair of sheet holding rollers 32 performs the adjustment and feed operation (step S8), the sheet P is held by the pair of sheet holding rollers 32, and the pair of sheet conveying rollers 31 (see FIGS. 2A and 2B) disposed upstream from the pair of sheet holding rollers 32 is separated from the sheet P (step S7). Therefore, a sheet conveying roller separation detection sensor 70 detects the separation of the pair of sheet conveying rollers 31, and a detection signal indicating the separation of the pair of sheet conveying rollers 31 is transmitted to a first motor control unit 62 and a second motor control unit 63. Consequently, the first motor control unit 62 and the second motor control unit 63 send respective signals to the first motor driver 621 and the second motor driver 631, respectively, so as to cause the pair of sheet holding rollers 32 to start the adjustment and feed operation.

As described above, the operation of the pair of sheet holding rollers 32 to return to the home position is performed after the fourth edge sensor 40 has detected the sheet P (step S16). That is, the detection information of the fourth edge sensor 40 is sent to the first motor control unit 62 and the second motor control unit 63, and the first motor driver 621 and the second motor driver 631 are driven respectively, so that the pair of sheet holding rollers 32 moves to the home position.

Further, the sheet conveyance motor control unit 64 is a portion that controls rotations of the pair of sheet holding rollers 32 (for sheet conveyance of the sheet P). A sheet conveyance motor driver 641 drives a sheet conveyance motor 642 according to a signal sent from the sheet conveyance motor control unit 64, so that the pair of sheet holding rollers 32 rotates for conveying the sheet P.

The pair of sheet holding rollers 32 is rotated after the t2 second (i.e., the time t2) when the sheet P reaches the second edge sensor 38 (steps S4 through S6). In other words, the detection information of the second edge sensor 38 is sent to the sheet conveyance motor control unit 64, and therefore the sheet conveyance motor 642 is driven.

The above-described embodiments are illustrative and do not limit this disclosure. It is therefore to be understood that within the scope of the appended claims, numerous additional modifications and variations are possible to this disclosure otherwise than as specifically described herein.

In the above-described embodiment, the fourth edge sensor 40 is disposed downstream from the pair of timing rollers 33 in the sheet conveying direction, so that the pair of sheet holding rollers 32 starts moving to the home position after the detection by the fourth edge sensor 40. That is, at the timing at which the sheet P reaches the pair of timing rollers 33 acting as a starting point, the pair of sheet holding rollers 32 is separated from the sheet conveyance passage 6 and the sheet P, and then the pair of sheet holding rollers 32 starts to move to the home position. However, the starting time of this operation is not limited to the above-described timing. For example, in a configuration including the secondary transfer roller 18 (and a pair of rollers formed by the secondary transfer roller 18 and the secondary transfer opposing roller 13) or a configuration including another pair of rollers provided between the pair of sheet holding rollers 32 and the secondary transfer roller 18, the fourth edge sensor 40 may be provided at a portion close to these rollers to make as a starting point. However, it is preferable to provide the fourth edge sensor 40 at a portion close to a roller to convey the sheet P after the pair of sheet holding rollers 32 (e.g., the pair of timing rollers 33 in the present embodiment), so that the pair of sheet holding rollers 32 moves to the home position at an earlier timing to prepare for the sheet conveyance and correcting operation of a subsequent sheet P.

In the above-described embodiment, the first CIS 34 is disposed upstream from the pair of sheet conveying rollers 31 in the sheet conveying direction. However, the first CIS 34 may be disposed downstream from the pair of sheet conveying rollers 31 in the sheet conveying direction.

The image forming apparatus 1 according to the present embodiment of this disclosure is applicable not only to a color image forming apparatus illustrated in FIG. 1 but also to a monochrome image forming apparatus, a copier, printer, facsimile machine, or multifunction printer including at least two functions of the copier, printer, and facsimile machine.

Further, in the present embodiment, the sheet conveying device 30 is provided to the electrophotographic image forming apparatus 1. However, the configuration is not limited thereto. For example, this disclosure can be also applied to a sheet conveying device that is provided to an inkjet image forming apparatus.

Figure 13:
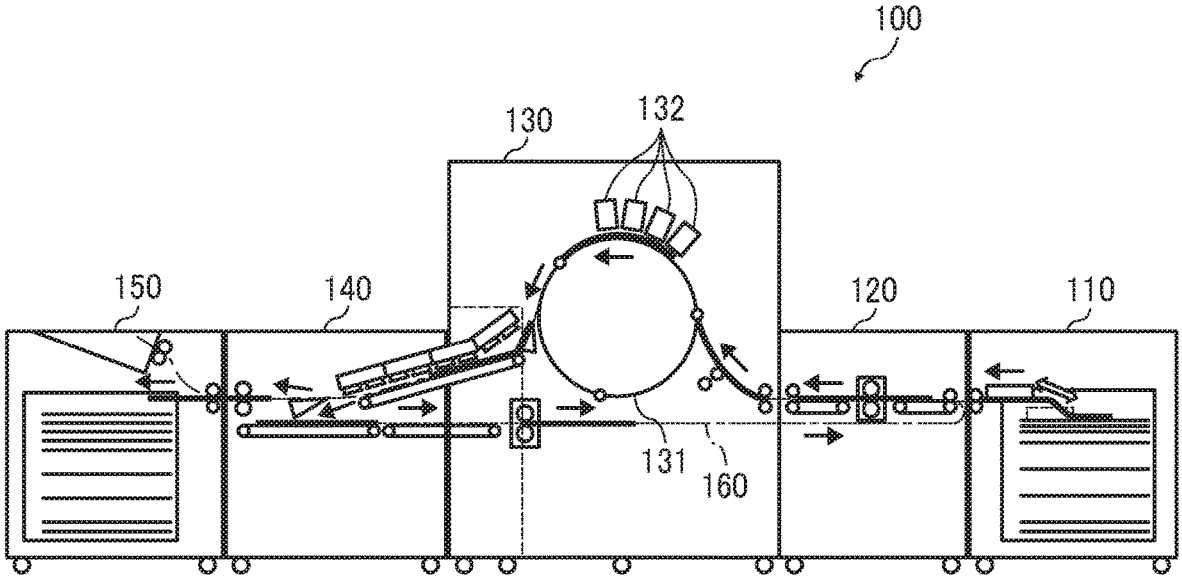
FIG. 13 is a diagram illustrating a schematic configuration of an image forming apparatus according to a different embodiment.

Next, a description is given of a basic configuration and operations of an inkjet image forming apparatus 100, with reference to FIG. 13.

FIG. 13 is a diagram illustrating a schematic configuration of the inkjet image forming apparatus 100 according to a different embodiment of this disclosure.

As illustrated in FIG. 13, the inkjet image forming apparatus 100 includes a sheet feeding device 110, a sheet conveying device 120, an image forming device 130, a drying device 140, and a sheet output device 150.

The sheet P fed from the sheet feeding device 110 is conveyed by the sheet conveying device 120 to the image forming device 130.

In the image forming device 130, the sheet P is positioned to a cylindrical drum 131. Then, along with rotation of the cylindrical drum 131, the sheet P is conveyed in a direction indicated by arrow in FIG. 13. Consequently, the sheet P is conveyed to a position below ink discharging heads 132 of respective colors (i.e., an image forming position to the sheet P) at respective predetermined timings. Then, ink of each color is sprayed onto the sheet P, so that an image is formed on the surface of the sheet P.

The sheet P having the image formed thereon by the image forming device 130 is conveyed to the drying device 140 where moisture in the ink on the surface of the sheet P is evaporated. Thereafter, the sheet P is ejected to the sheet output device 150, at a position where the sheet P can be easily picked up by a user.

When the duplex printing is performed to the sheet P, the sheet P after completion of the drying process travels in a sheet reversal passage 160 to be further conveyed to the sheet conveying device 120 while the sheet P is reversed with the front face down.

By applying the above-described configuration of the sheet conveying device 30 according to this disclosure to the sheet conveying device 120, the sheet conveying device 120 can achieve the same effect as the above-described sheet conveying device 30. That is, the sheet conveying device 120 corrects the angular and lateral displacements of the sheet P. With the configuration described above, the sheet conveying device 120 can correct the angular and lateral displacements of the sheet P with respect to the sheet conveyance passage of the sheet P while conveying the sheet P at high speed. By so doing, the absolute positional deviation of the image formed on the sheet P, relative to the sheet P, can be corrected.

Further, when the duplex printing is performed, by correcting the relative positional deviations of relative images on the front and back faces of a sheet, the relative positional deviation of the image formed on the front face of the sheet P and the image formed on the back face of the sheet P can also be removed.

Then, the sheet P is conveyed to the image forming device 130 disposed downstream from the sheet conveying device 120 in the sheet conveying direction, in a state in which the angular and lateral displacements of the sheet P are corrected.

In addition, the "sheet" includes the sheet P (plain papers), thick papers, postcards, envelopes, thin papers, coated papers (coated papers, art papers, etc.), tracing papers, OHP sheets, plastic films, prepreg, copper foil, etc.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a pair of rotary bodies configured to convey the sheet and correct at least one of an angular displacement of the sheet and a lateral displacement of the sheet by at least one of rotating about a fulcrum within a plane of sheet conveyance and moving in a width direction perpendicular to the sheet conveying direction;

a pair of downstream side sheet conveying bodies, disposed relatively downstream from the pair of rotary bodies in a sheet conveying direction, configured to convey the sheet;

an edge sensor, disposed relatively downstream from the pair of downstream side sheet conveying bodies in the sheet conveying direction, configured to detect the sheet; and a controller configured to control the pair of rotary bodies in accordance with a signal from the edge sensor, wherein the controller controls the pair of rotary bodies to correct the positional deviation of the sheet by moving from a home position on a sheet conveyance passage through which the sheet passes, and controls the pair of rotary bodies to separate from the sheet conveyance passage of the sheet, after the sheet has arrived at the pair of downstream side sheet conveying bodies and before a front end position of the sheet reaches the edge sensor, and then controls the pair of rotary bodies to move to the home position, after the edge sensor has detected the sheet and while the pair of downstream side sheet conveying bodies convey the sheet.

2. The sheet conveying device of claim 1, wherein the edge sensor is configured to indirectly detect separation of the pair of rotary bodies.

3. The sheet conveying device of claim 2, wherein the pair of rotary bodies are configured to separate from the sheet immediately after the pair of downstream side sheet conveying bodies start to convey the sheet, and wherein the edge sensor is disposed on a downstream side of the pair of downstream side sheet conveying bodies in the sheet conveying direction, and is configured to detect the separation of the pair of rotary bodies from the sheet.

4. The sheet conveying device of claim 1, further comprising a sheet detector configured to detect the sheet, wherein the pair of rotary bodies are configured to start correction of the sheet after the sheet detector has detected the sheet.

5. The sheet conveying device of claim 4, wherein, when the sheet detector remains for a set time period without detecting the sheet, the set time period being equal to a threshold amount of time passing after detecting the sheet, a trailing end of the sheet is determined to have passed the sheet detector, and then the pair of rotary bodies are configured to start correction of a subsequent sheet.

6. The sheet conveying device of claim 5, wherein the set time period is determined based on a size of a punch opening formed in the sheet.

7. The sheet conveying device of claim 4, further comprising:

a pair of upstream side sheet conveying bodies disposed at a distance less than a length of the sheet relatively upstream from the pair of rotary bodies in the sheet conveying direction, wherein the sheet detector is disposed on a downstream side of the pair of upstream side sheet conveying bodies in the sheet conveying direction.

8. The sheet conveying device of claim 1, further comprising:

an upstream side sheet detector, disposed relatively upstream from the pair of rotary bodies in the sheet conveying direction, configured to detect the sheet, wherein, the pair of rotary bodies are configured to convey the sheet and correct the positional deviation of the sheet subsequent to the sheet being detected by the upstream side sheet detector.

9. The sheet conveying device of claim 1, further comprising:

multiple sheet positional deviation detectors configured to detect a position of the sheet, the multiple sheet positional deviation detectors including an upstream side sheet positional deviation detector disposed relatively upstream from the pair of rotary bodies in the sheet conveying direction, wherein, based on a detection result obtained by the upstream side sheet positional deviation detector of the multiple sheet positional deviation detectors, an amount of positional deviation of the sheet is calculable and wherein the pair of rotary bodies are configured to correct the amount of positional deviation of the sheet.

10. The sheet conveying device of claim 9, further comprising:

a downstream side sheet detector, disposed relatively downstream from the pair of rotary bodies, configured to detect the sheet, wherein the multiple sheet positional deviation detectors include a downstream side sheet positional deviation detector, disposed downstream from the downstream side sheet detector in the sheet conveying direction, wherein, the downstream side sheet positional deviation detector of the multiple sheet positional deviation detectors are configured to detect the sheet subsequent to the sheet being detected by the downstream side sheet detector, and wherein, based on at least a detection result obtained by the downstream side sheet positional deviation detector, the pair of rotary bodies are configured to correct the positional deviation of the sheet again.

11. The sheet conveying device of claim 1, wherein the pair of rotary bodies includes a pair of rollers configured to hold and convey the sheet.

12. An image forming apparatus comprising the sheet conveying device of claim 1.

13. The image forming apparatus of claim 12, wherein the pair of downstream side sheet conveying bodies include a transfer roller configured to transfer an image onto the sheet.

14. A sheet conveying device comprising:

a pair of rotary bodies configured to convey the sheet and correct at least one of an angular displacement of the sheet and a lateral displacement of the sheet by at least one of rotating about a fulcrum within a plane of sheet conveyance and moving in a width direction perpendicular to the sheet conveying direction;

a pair of downstream side sheet conveying bodies, disposed relatively downstream from the pair of rotary bodies in a sheet conveying direction, configured to convey the sheet;

an edge sensor, disposed relatively downstream from the pair of downstream side sheet conveying bodies in the sheet conveying direction, configured to detect the sheet; and a controller configured to control the pair of rotary bodies in accordance with a signal from the edge sensor, wherein the controller controls the pair of rotary bodies to correct the positional deviation of the sheet by moving from a home position on a sheet conveyance passage through which the sheet passes, controls the pair of rotary bodies to separate from the sheet conveyance passage of the sheet, after the sheet has arrived at the pair of downstream side sheet conveying bodies and before the sheet reaches the edge sensor and before a front end position of the sheet reaches the edge sensor, and controls the pair of rotary bodies to move to the home position, after the edge sensor has detected the sheet and while the pair of downstream side sheet conveying bodies convey the sheet.

15. An image forming apparatus comprising the sheet conveying device of claim 14.

16. The image forming apparatus of claim 15, wherein the pair of downstream side sheet conveying bodies include at least one of a transfer roller, configured to transfer an image onto the sheet, and a pair of sheet conveying rollers, disposed relatively upstream from the transfer roller in the sheet conveying direction.

17. A sheet conveying device comprising:

a pair of rotary bodies configured to convey the sheet and correct at least one of an angular displacement of the sheet and a lateral displacement of the sheet by at least one of rotating about a fulcrum within a plane of sheet conveyance and moving in a width direction perpendicular to the sheet conveying direction;

a pair of downstream side sheet conveying bodies, disposed relatively downstream from the pair of rotary bodies in a sheet conveying direction, configured to convey the sheet;

an edge sensor, disposed on a downstream side of the pair of downstream side sheet conveying bodies in the sheet conveying direction, configured to detect the sheet; and a controller configured to control an operation of the pair of rotary bodies, the controller being configured to cause the pair of rotary bodies to correct the positional deviation of the sheet by moving the pair of rotary bodies from a home position on a sheet conveyance passage through which the sheet passes, the controller being configured to cause the pair of rotary bodies to separate from the sheet conveyance passage of the sheet, after the sheet has arrived at the pair of downstream side sheet conveying bodies and before a front end position of the sheet reaches the edge sensor, and the controller being configured to cause the pair of rotary bodies to move to the home position, after the edge sensor has detected the sheet and while the pair of downstream side sheet conveying bodies convey the sheet.

18. An image forming apparatus comprising the sheet conveying device of claim 17.

19. The image forming apparatus of claim 18, wherein the pair of downstream side sheet conveying bodies include at least one of a transfer roller, configured to transfer an image onto the sheet, and a pair of sheet conveying rollers, disposed relatively upstream from the transfer roller in the sheet conveying direction.

* * * * *